US007677301B2

(12) United States Patent
Blomgren

(10) Patent No.: US 7,677,301 B2
(45) Date of Patent: Mar. 16, 2010

(54) HEAT TRANSFER PLATE, PLATE PACK AND PLATE HEAT EXCHANGER

(75) Inventor: Ralf Blomgren, Skanör (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 10/481,196

(22) PCT Filed: Jun. 4, 2002

(86) PCT No.: PCT/SE02/01062

§ 371 (c)(1),
(2), (4) Date: Dec. 17, 2003

(87) PCT Pub. No.: WO03/006911

PCT Pub. Date: Jan. 23, 2003

(65) Prior Publication Data

US 2004/0206487 A1 Oct. 21, 2004

(30) Foreign Application Priority Data

Jul. 9, 2001 (SE) ..... 0102451

(51) Int. Cl.
*F28F 3/08* (2006.01)

(52) U.S. Cl. ..... 165/167; 165/174

(58) Field of Classification Search ..... 165/167, 165/916, 174

See application file for complete search history.

(56) References Cited

U.S. PATENT DOCUMENTS 2,550,339 A * 4/1951 Ehrman ..... 165/167
2,677,531 A * 5/1954 Hock et al. ..... 165/167
4,347,896 A * 9/1982 Rosman et al. ..... 165/166

(Continued)

FOREIGN PATENT DOCUMENTS

DE 3600656 A1 * 7/1987 ..... 165/167

(Continued)

OTHER PUBLICATIONS

Baranovsky, N.V., "Plate and coil heat exchangers," 1973, pp. 20-27, 62-69.

(Continued)

*Primary Examiner*—Leonard R Leo
(74) *Attorney, Agent, or Firm*—Fish & Richardson P.C.

(57) ABSTRACT

A heat transfer plate for a plate heat exchanger has a first port portion (A) with at least one port (1, 4) for each of two fluids and a second port portion (B) with at least one port (2, 3) for each of the fluids, and a heat transfer portion which is located between the port portions (A, B). The ports (1, 4) in the first port portion (A) are located along a first geometric line (LA; LA1-LA2) which is essentially parallel to a longitudinal direction (L) of the plate, while the ports (2, 3) in the second port portion (B) are located along a second geometric line (LB; LB1-LB2) which is essentially parallel to the longitudinal direction (L) of the plate. A flow limiter (5) is arranged at least in the first port portion (A) adjacent to at least one of the ports which is located nearest the second port portion (B). The second port portion (B) has a corresponding flow limiter (6).

15 Claims, 8 Drawing Sheets

U.S. PATENT DOCUMENTS

| | | | | | |
|---|---|---|---|---|---|
| 4,523,638 | A | | 6/1985 | Rosman et al. | |
| 4,708,199 | A | | 11/1987 | Yogo et al. | |
| 4,987,955 | A | * | 1/1991 | Bergqvist et al. | 165/167 |
| 5,062,477 | A | * | 11/1991 | Kadle | 165/174 |
| 5,146,980 | A | | 9/1992 | Le Gauyer | |
| 5,462,113 | A | * | 10/1995 | Wand | 165/167 |
| 5,954,126 | A | * | 9/1999 | Armbruster | 165/167 |
| 6,199,626 | B1 | * | 3/2001 | Wu et al. | 165/167 |

FOREIGN PATENT DOCUMENTS

| | | | | | |
|---|---|---|---|---|---|
| DE | 3824073 | A1 | * | 2/1990 | 165/916 |
| DE | 94 05 012 | | | 6/1994 | |
| DE | 197 16 200 | | | 10/1998 | |
| EP | 0 411 123 | | | 2/1991 | |
| EP | 0 548 360 | | | 6/1993 | |
| EP | 622600 | A1 | * | 11/1994 | 165/916 |
| GB | 2005398 | A | * | 4/1979 | 165/167 |
| JP | 61-86590 | | | 5/1986 | |
| JP | 62-293086 | | | 12/1987 | |
| JP | 06117783 | A | * | 4/1994 | |
| JP | 8-247690 | | | 9/1996 | |
| WO | WO 9967041 | A1 | * | 12/1999 | |

OTHER PUBLICATIONS

"Heat exchangers reference book," 1987, Moscow, vol. 2, pp. 298-301.

English translation of Russian office action of Feb. 26, 2006.

Translation of JP office action mailed Oct. 9, 2007.

* cited by examiner

HEAT TRANSFER PLATE, PLATE PACK AND PLATE HEAT EXCHANGER

FIELD OF THE INVENTION

The present invention relates to a heat transfer plate for plate heat exchangers comprising a first port portion which is located in a first edge portion of the heat transfer plate and which comprises at least one port for each of two fluids, a second port portion which is located in a second edge portion of the heat transfer plate and which comprises at least one port for each of the fluids, and a heat transfer portion which is located between said port portions, the ports in the first port portion being located along a first geometric line which is essentially parallel to a longitudinal direction of the plate, and the ports in the second port portion being located along a second geometric line which is essentially parallel to the longitudinal direction of the plate. The invention also relates to a plate pack and a plate heat exchanger.

BACKGROUND ART

A plate heat exchanger comprises a plate pack of a number of assembled heat transfer plates forming between them plate interspaces. In most cases, every second plate interspace communicates with a first inlet channel and a first outlet channel, each plate interspace being adapted to define a flow area and to conduct a flow of a first fluid between said inlet and outlet channels. Correspondingly, the other plate interspaces communicate with a second inlet and a second outlet channel for a flow of a second fluid. Thus the plates are in contact with one fluid through one of their side surfaces and with the other fluid through the other side surface, which allows a considerable heat exchange between the two fluids.

Modern plate heat exchangers have heat transfer plates, which in most cases are made of sheet metal blanks which have been pressed and punched to obtain their final shape. Each heat transfer plate is usually provided with four or more "ports" consisting of through holes punched at the four corners of the plate. In some cases, additional ports are punched along the short sides of the plates so as to be located between the ports punched in the corners. The ports of the different plates define said inlet and outlet channels, which extend through the plate heat exchanger transversely of the plane of the plates. Gaskets or some other type of sealing means are alternatingly arranged round some of the ports in every second plate interspace and, in the other plate interspaces, round the other ports so as to form the two separate channels for the first and the second fluid, respectively.

Since considerable fluid pressure levels are obtained in the heat exchanger during operation, the plates need to be sufficiently rigid so as not to be deformed by the fluid pressure. The use of plates made of sheet metal blanks is possible only if the plates are somehow supported. This is usually achieved by the heat transfer plates being formed with some kind of corrugation so that they bear against each other at a large number of points.

The plates are clamped together between two flexurally rigid end plates (or frame plates) in a "frame" and thus form rigid units with flow channels in every plate interspace. The end plates are clamped against each other by means of a number of clamp bolts which engage both plates in holes formed along the circumference of each end plate. In some plate heat exchangers, the plates are joined by welding or soldering, in which case the purpose of the end plates is to protect the heat transfer plates of the heat exchanger.

When designing a plate exchanger of the above type for use at relatively high pressures, special considerations have to be made. A heat transfer plate which is intended for use in applications involving relatively low pressures may have a large heat transfer surface. If said fluid is supplied under high pressures, the large heat transfer surface will cause great forces which must then be absorbed by the frame or the solder between the plates.

The bending moment exerted on an end plate owing to the liquid pressure is proportional to the width of the plate raised to the second power. At pressures of 100-150 bar (10-15 MPa) extremely thick end plates are necessary to allow use of wide heat transfer plates with large ports of the type described above in general.

Moreover the clamp bolts must be dimensioned to resist the force required for the plate pack to be clamped sufficiently hard for a correct seal to be obtained. For each bolt not to be too thick and unwieldy to handle, a large number of bolts will be required in high pressure applications. In dimensioning for extremely high pressures, the problem sometimes arises that there is no space along the circumference of the plates for all the bolts that would be required.

Furthermore it is necessary to use strong frames, which makes the construction still more expensive. Especially in plate heat exchangers with a relatively small number of plates in which the frame cost constitutes a large part, this construction will be too expensive relative to the achieved heat transfer capacity.

In this context, also the type of plate heat exchanger as described in DE-A1-19716200 should be mentioned. This publication discloses a plate heat exchanger where all ports, i.e. also the ports for the different fluids, are positioned along one and the same line. The object stated in the DE publication is that it is desirable to obtain an improved distribution of the flow over the width of the heat transfer plates. The shape of the plate is essentially long narrow and rectangular, and the two ports for one of the fluids are positioned at the outer end of each short side of the plate whereas the two ports for the other fluid are positioned inside the same. As a result, the flow between the two outer ports is distributed along the whole width of the heat transfer plate, but the flow between the two inner ports will have a very poor distribution over the width of the plate. Thus, nor does this configuration offer a convenient solution to the above problems.

Mention should also be made of another type of plate heat exchanger where narrow plates are commonly used, viz. a very special type of heat exchanger, referred to as falling film evaporator. Such heat exchangers are described, for instance, in EP-A1-548360 and EP-A1-411123. A falling film evaporator is used to evaporate water or some other liquid from, for instance, fruit juice, sugar solutions or the like to obtain a higher concentration of the fruit juice or the sugar in the solution.

In such a falling film evaporator, a very special type of long narrow plates and a special sealing system are used. Vapour is in most cases supplied through a port which is positioned in the uppermost part and is passed downwards in every second plate interspace so as to be finally discharged from the evaporator through one or more ports positioned in the lowest part of the plate. The fluid from which liquid is to be evaporated is supplied through an upper port and discharged through a lower port. However, the upper port is not positioned in the upper part of the plate but it is displaced a considerable distance down towards the lower port. The liquid rises in a narrow, elongate preheating channel provided by gaskets from the inlet port until it reaches the upper part of the plate where it is then passed downwards on both sides of the preheating channel to an outlet port located in the lower portion of the plate. In EP-A1-411123, the inlet port is positioned in the lower portion of the plate, and in EP-A1-548360 the upper port is positioned just above the centre of the plate. This construction is only intended to be used for the very special flow conditions prevailing in falling film evaporators and would not function at all in conventional fields of application for ordinary plate exchangers. If this construction would be used for great flows, the pressure drop would be extremely high, which would cause an unsatisfactory degree of efficiency.

Moreover, the plate heat exchanger according to U.S. Pat. No. 4,708,199 should be commented on. This patent discloses a circular plate with a number of flanged through holes and plane openings which are alternatingly positioned on the same radius and with the same pitch in the circumferential direction. A number of plates are stacked one each other, each plate being rotated by a pitch in relation to the subjacent. The flanges round the holes provide a seal against the underside of the superposed plate and thus define this hole towards the flow area obtained between the plate in question and the plate above. Since the plates are rotated by a pitch relative to each other, every second port will communicate with every second flow area. This special construction has been developed for use in welded plate heat exchangers with the aim of not requiring two different plates that are alternatingly stacked on each other. However, this construction is not satisfactory when used at high pressures since circular plates give a maximum span in relation to a given heat transfer surface and are thus exposed to excessive loads.

There is thus no fully satisfactory conventional heat exchanger concept which can be used at high pressures. The variants that are available suffer from various drawbacks. For instance, they cause the construction of the frame to be unnecessarily heavy, the metal sheet to be poorly used or the flow to be unsatisfactorily distributed over the width of the plates. Above all, the latter problem of distribution must be solved since the efficiency of a plate heat exchanger is highly dependent on a good distribution of the flow of fluids over the whole width of the plate.

SUMMARY OF THE INVENTION

One object of the invention is to provide a solution to the above problems. A special object is to provide a good flow distribution in plate heat exchangers of the type described above. It is also an object to provide a construction which makes it possible to build simple and inexpensive frames compared with the known constructions in applications involving fluids under relatively high pressure. One more object is to provide a construction which allows better utilisation of the material of the heat transfer plates. Additional objects and advantages of the invention will be evident from the following description.

The objects of the invention are achieved by means of a heat transfer plate which is of the type stated above and which is characterised in that a flow limiter is arranged at least in the first port portion adjacent to at least one of the ports which is located nearest the second port portion, the flow limiter is of such an extent that each straight geometric line, which is designed to extend between said port and a port which is located in the opposite port portion and is intended for the same fluid, extends through said flow limiter, and the flow limiter is located between said port and the second port portion.

By designing the heat transfer plate in this way a construction is obtained, in which a good degree of utilisation of the heat transfer surface of the plate is achieved. This means in turn that it will be possible to make the heat transfer plates and thus also the frame plates as small as possible. Moreover the location of the ports results in itself in a good distribution of the fluid flow from the port that is positioned furthest away from the opposite port portion. In contrast to prior-art constructions, the new construction further allows a good distribution of the fluid flow also from the port that is positioned nearest the opposite port portion. This is achieved by means of the flow limiter, which is arranged adjacent to at least one of said ports.

Since the flow limiter extends in the above-defined way adjacent to said port, a good distribution of the fluid flowing to or from the port is obtained, without causing a very great pressure drop. This construction feature ensures that a fluid flow cannot flow directly between two ports but must be deflected or at least affected by a flow limiter on its way from the inlet port to the outlet port.

Furthermore the flow limiter is positioned between said port and the second port portion, which causes the fluid flow to be distributed over the whole width of the heat transfer portion instead of being conducted directly to the corresponding inlet or outlet port. Besides the flow limiter makes it possible to control the flowing distance of the fluids so that both fluids flow along a distance which is of essentially the same length, which is advantageous as regards optimisation of the heat exchange between the fluids. In view of that stated above, it is possible to design the plates in such a manner that they are narrow while at the same time a good degree of efficiency as regards the heat exchange is achieved. This is particularly advantageous in applications involving high pressures of the fluids since wide plates would require very strong and expensive frames and frame plates. The inventive construction thus offers a solution to the above problems.

Preferred embodiments will be defined in the dependent claims.

According to a preferred embodiment, said port provided with a flow limiter constitutes an inlet port for one of the fluids. By directing the inflow of a fluid, a good distribution of said fluid is already obtained when supplying the fluid.

According to a preferred embodiment, said port provided with a flow limiter constitutes an outlet port for one of the fluids. By controlling the outflow of a fluid, a good distribution of said fluid is achieved over the whole width of the plate also in the last portion just before outflow through the outlet port.

Preferably the flow limiter extends in the circumferential direction along about half of the circumference of said port, which ensures a good distribution of the flow.

Advantageously an additional or a second flow limiter is arranged in the second port portion adjacent to one of the ports which on the one hand is positioned nearest the first port portion and, on the other hand, constitutes an outlet port for one of the fluids. This results in a good distribution of the two fluids. Depending on the location of the ports, the first flow limiter is positioned adjacent to a corresponding inlet port or adjacent to an outlet port for the other fluid. The need for flow limiters is above all pronounced when designing the port or ports in the respective port portions which is/are positioned nearest the opposite port portion. The port which is positioned nearest the opposite port portion constitutes in most cases a sufficient flow limiter for the flow to or from the port or ports which is/are positioned furthest away from the opposite port portion.

Advantageously the second flow limiter satisfies constructional requirements similar to those made on the first flow limiter. To explain the contributions of the different features, reference is made to the corresponding explanation regarding the first flow limiter.

According to a preferred embodiment, a flow limiter comprises a pressed ridge which is formed integrally with the plate and which is arranged to abut against an adjoining heat transfer plate in the mounted position of the plate in a plate heat exchanger. This is a construction which is advantageous in terms of manufacture. By using a plate formed with a ridge, it is possible to assemble, for instance, plate packs with plates that are welded together in pairs. Such a construction is, for example, favourable in applications where one fluid is fruit juice, a sugar solution or some other fluid requiring cleaning of the plates at regular intervals, and the other fluid is water. Since only every second plate interspace needs to be cleaned and handling should be as simple as possible in dismounting, it is convenient for only the interspaces to be accessible that need to be cleaned and that the other are accommodated in the cassettes that are being handled.

According to a preferred embodiment, a flow limiter comprises a pressed trough which is formed integrally with the plate and a gasket which is arranged in the trough and which is adapted, in the mounted position in a plate heat exchanger, to abut against an adjoining heat transfer plate. This is a construction which is advantageous in terms of manufacture. For instance, this construction can be used when it is desirable to manufacture one type of plate as regards ports and patterns, but to obtain two types of plates as regards gaskets round ports and the like. By using gaskets in the correct way, it is then possible to obtain two different plates that can be used alternatingly and that can be made of one and the same type of pressed metal sheet. Since the press tools are expensive, it is desirable to be able to use plate configurations requiring only one type of press pattern and, thus, only one press tool.

In a preferred embodiment, the ports in each of the port portions are positioned along one and the same geometric line. This renders it possible to make the heat transfer plate very narrow, to automatically obtain a flow distribution of the flow to and from the ports which are positioned furthest away from the opposite port portion and to obtain a port configuration which is easy to design so that the plate is usable alternatingly.

According to another preferred embodiment, the first geometric line along which the ports in the first port portion are positioned is essentially parallel to and displaced a distance in a transverse direction of the heat transfer plate in relation to the second geometric line along which the ports in the second port portion are positioned. With this design, it is possible to obtain, for instance, a plate which is usable alternatingly and which provides a flow path of the same length for both fluids. Furthermore the location of the ports makes it easy to obtain a good flow distribution over the whole width of the plate.

In a preferred embodiment, the flow limiter is partly open along its extent in the circumferential direction to enable a partial fluid flow through the flow limiter. This design results in an excellent flow distribution over the whole width of the plate. In some applications, a fully tight flow limiter could cause too small a flow adjacent to the flow limiter at the flow limiter side facing away from the port. A small partial flow through the flow limiter eliminates this risk.

According to a preferred embodiment, the ports which in the respective port portions are positioned nearest the opposite port portion are intended for a first fluid and the ports which in the respective port portions are positioned furthest away from the opposite port portion are intended for a second fluid. In this manner, it is possible to use, for instance, the fact that a fluid which is subject to a phase change from vapour to liquid or vice versa need not have a flow path of the same length to cause the same amount of heat exchange as a fluid that is not subject to any phase change. Moreover the ports located nearest the opposite port portion automatically provide a flow distributing effect for the fluid flow between the ports which are located furthest away from the opposite port portion.

To obtain a heat transfer plate which is usable alternatingly, the ports are arranged symmetrically in relation to a symmetry line. Depending on whether the plate is to be designed for phase change of one fluid, both fluids or none of the fluids, this symmetry line may be selected in various ways.

The above objects of the invention are achieved also by means of a plate pack and a plate heat exchanger of the type as defined in the respective independent claims.

BRIEF DESCRIPTION OF THE DRAWINGS

The invention will now be described in more detail with reference to the accompanying schematic drawings which by way of example illustrate currently preferred embodiments of the invention.

DETAILED DESCRIPTION OF PREFERRED EMBODIMENTS

Figure 1:
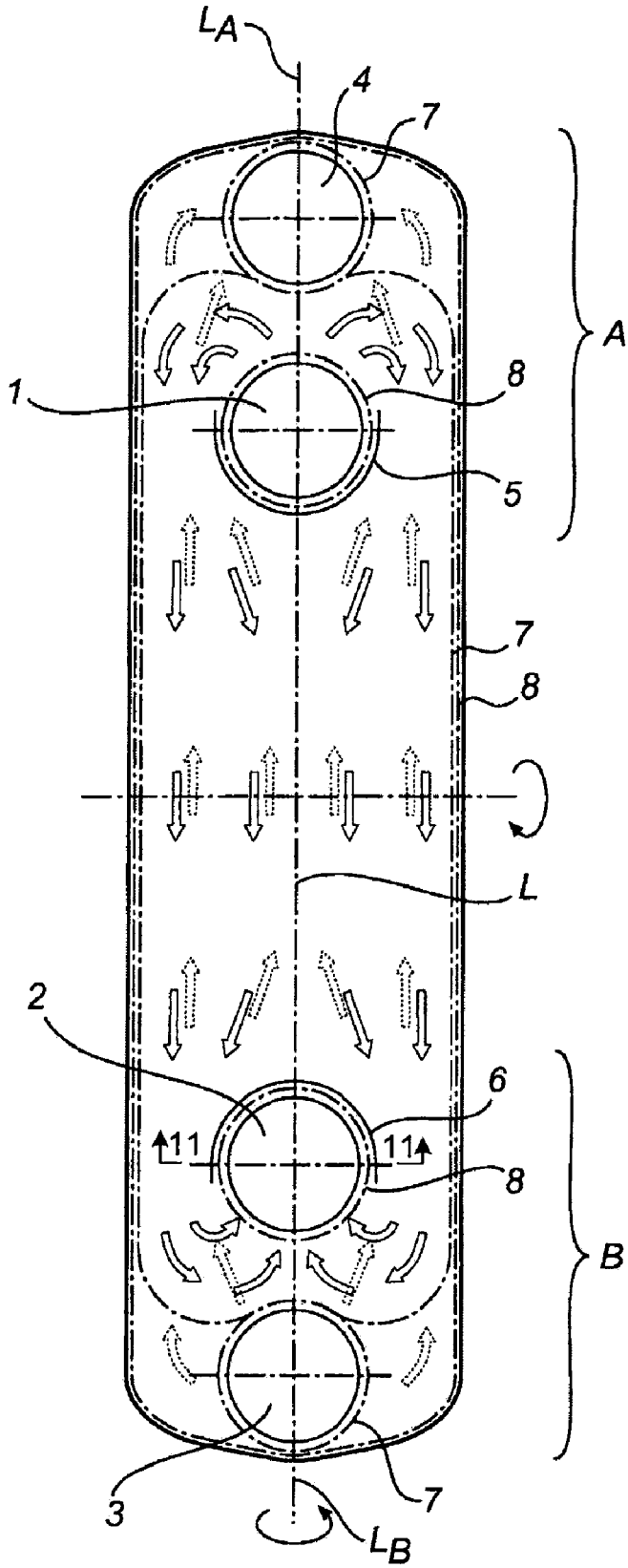
FIG. 1 shows a heat transfer plate which is usable alternatingly by rotation about its longitudinal axis or its transverse axis.

As is evident from the Figures, the heat transfer plate according to the preferred embodiments is of elongate, essentially rectangular shape. At each short side, a port portion A, B is formed. In each port portion A, B two through holes, so-called ports 1-4, are formed. These plates are intended to be assembled to a plate pack in a conventional way in such a manner that each of the ports 1-4 will form a channel extending through the plate pack. The first port 1 forms a first inlet channel which is intended for a first fluid while the second port 2 forms a first outlet channel which is intended for said fluid. The third port 3 forms a second inlet channel which is intended for a second fluid and the fourth port 4 forms a second outlet channel which is intended for said fluid.

As a rule every second plate interspace communicates with the first inlet channel and the first outlet channel, each plate interspace being adapted to define a flow area and to conduct a flow of the first fluid between said inlet and outlet channels. Correspondingly, the other plate interspaces communicate with the second inlet channel and the second outlet channel for a flow of the second fluid. Thus the plates are in contact with one fluid through one of their side surfaces and with the other fluid through their other side surface, which allows a considerable heat exchange between the two fluids. The Figures illustrate how the flow of each fluid is intended to occur on each side of the plate. Solid arrows indicate the flow on the upper side relative to the plane of the drawing, and dashed arrows illustrate the flow on the lower or rear side relative to the plane of the drawing.

As is evident from the Figures, the heat transfer plate further comprises flow limiters 5-6 which are arranged adjacent to the port in the respective portions which is located nearest the opposite port portion. The flow limiters 5-6 are formed as a pressed ridge adapted to abut against a corresponding ridge of an adjoining plate. As flow limiters 5, 6 it is also possible to use a gasket which is arranged in a pressed groove in the two juxtaposed plates. The Figures show, by means of solid lines, sealing gaskets or flow limiters welded, together on the shown side formed with ridges intended for welding, shown as thin dash dot lines, and on the other side formed with ridges intended for welding or, on this side, formed with non-filled gasket grooves shown by dash dot lines.

The flow limiters 5, 6 can be straight or be of some other preferred shape which is chosen, for instance, for reasons of flow. The flow limiters 5-6 shown in the Figures extend preferably approximately along half of the circumference of the respective ports and extend essentially in the form of a semicircle. The flow limiters 5-6 are located at the side of the port facing the opposite port portion.

In the description above, specific embodiments have not been taken into consideration and the description above is applicable to embodiments that will be described below, if not otherwise stated in connection with the description of each embodiment.

In the embodiment shown in FIG. 1, the heat transfer plate comprises a first inlet port 1 in the upper port portion A and a first outlet port 2 in the lower port portion B, which ports are intended for a flow of a first fluid. Moreover the plate 1 has a second inlet port 3 in the lower port portion B and a second outlet port 4 in the upper port portion A, which ports are intended for a flow of a second fluid.

The plate is intended for all-welded or brazed heat exchangers and is formed with a number of parallel ridges 7 and troughs 8 intended for welding, along its periphery and round its ports. On the side directed upwards from the plane of the drawing, the plate has an inner flow limiting area which is surrounded by an inner ridge 7 which is adapted to be welded together with a corresponding ridge of an adjoining plate. Furthermore there is a corresponding ridge 7 round each of the two outer ports 3, 4. The ridges 7 are indicated by a dash dot line. On the other side, the plate 1 has a ridge (trough 8 on the side of the plate shown in FIG. 1) which extends along the periphery of the plate and which is adapted to be welded together with a corresponding ridge of an adjoining plate. Moreover there is a corresponding ridge (trough 8 on the side of the plate shown in FIG. 1) round each of the two inner ports 1, 2. In this manner, it has been ensured that the entire heat exchanger has been sealed against the environment and every second plate interspace is in fluid communication with two of the ports while the remaining plate interspaces are in fluid communication with the remaining ports. If the plates are made of pressed metal sheet, a ridge on one side will cause a trough on the opposite side, which in turn means that ridges on different sides of the plates can intersect only if extra material is added. It is therefore important to note which ridge is the innermost and outermost in the respective cases in relation to the periphery of the plate and the ports respectively.

As is evident from FIG. 1, the flow between the two outer ports 3, 4 will be forced to be distributed over the whole width of the plate since the inner port 1, 2 in each port portion must be sealed against the second fluid flow (dashed arrows). The second fluid flow is thus forced to be divided into a partial flow on each side of the two inner ports 1, 2. To be able to distribute the first fluid flow (solid arrows), the above-mentioned flow limiters 5, 6 are arranged between the respective ports 1, 2 and the opposite port portion.

Figure 11:
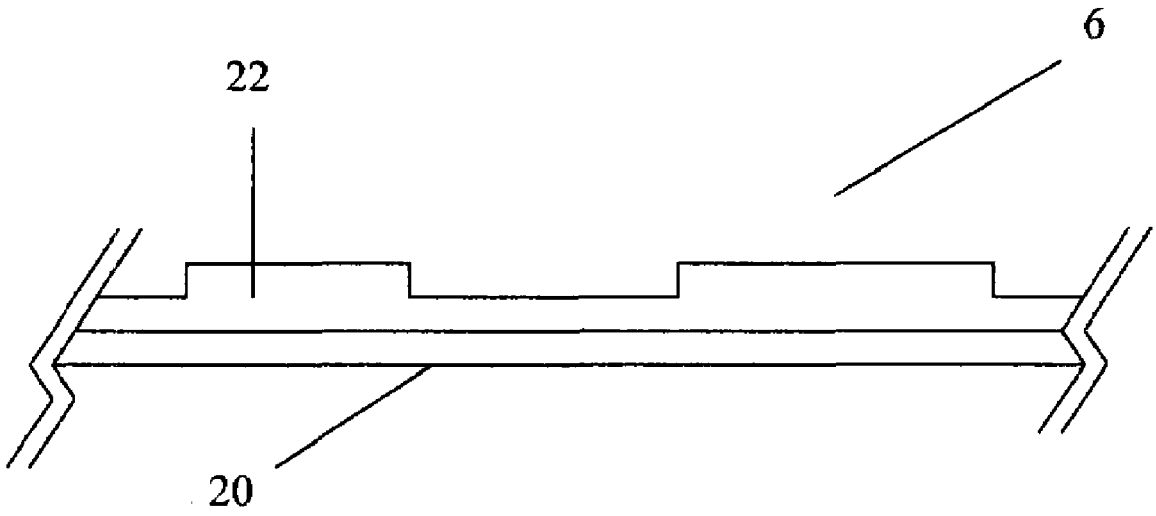
FIG. 11, which of course is not to scale, shows a partial cross-sectional view of one implementation of FIG. 10 from view C-C. The implementation includes a plate 20 and a gasket or ridge 22. A more or less broken-through flow limiter 6 is provided by the gasket or the ridge 22 being made somewhat lower along some short distances over the extent of the flow limiter 6.

FIG. 11 illustrates a section through the plate of FIG. 1, near for example, port 2 of FIG. 1. Flow limiter 6 comprises a pressed ridge formed on the heat transfer plate and the top of the pressed ridge abuts the adjoining plate as illustrated in FIG. 12. Welding can be used to join trough 8 to a ridge of the adjacent plate.

Figure 2:
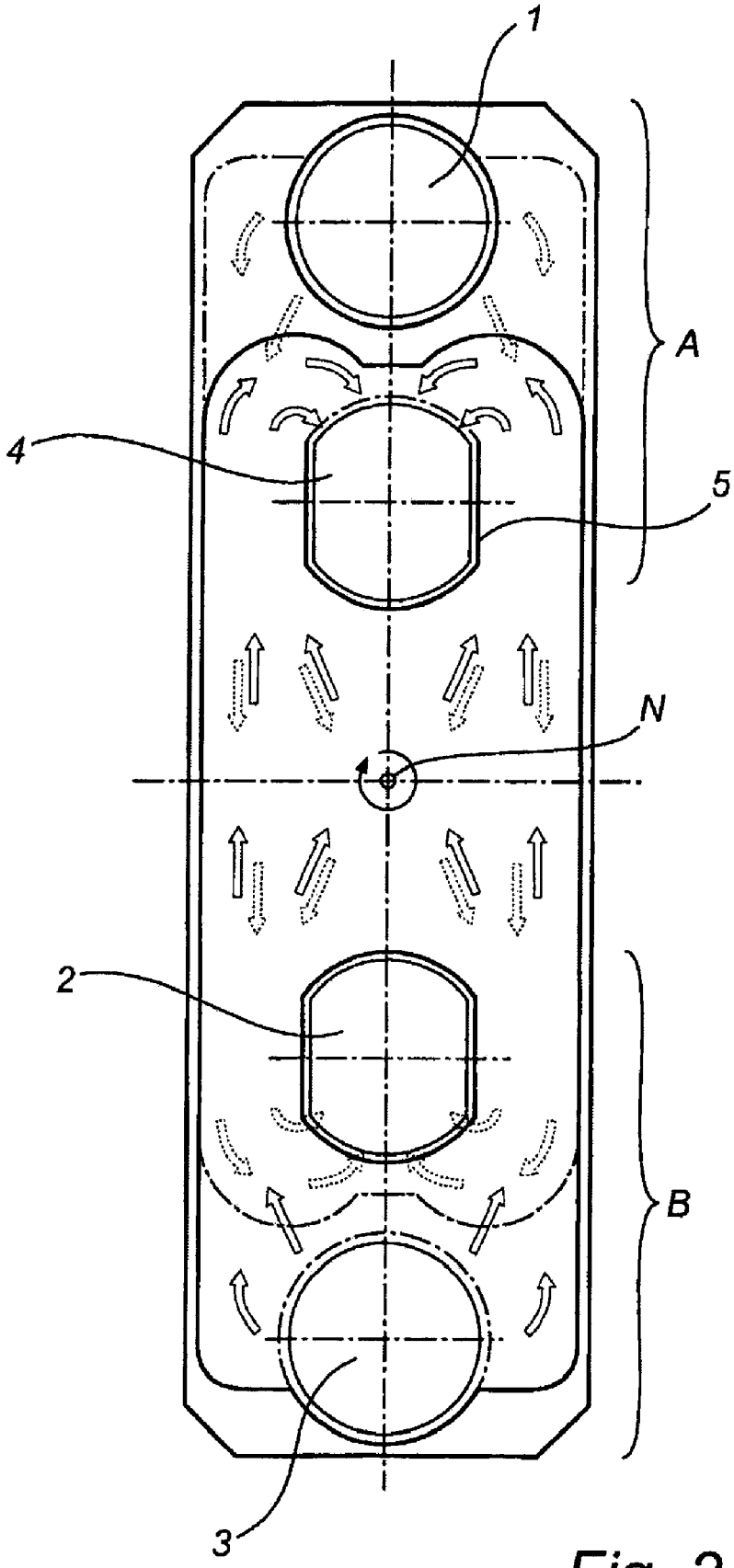
FIG. 2 shows a heat transfer plate which is usable alternatingly by rotation about a normal to the plane of the plate, placed in the centre of the plate.

FIG. 2 shows another preferred embodiment. In this design, the port 1 which is the outer port in one port portion (i.e. the port located furthest away from the opposite port portion) is in fluid communication with the port 2 which is the inner port in the other port portion (i.e. the port which is located nearest the opposite port portion). The plate is provided with gaskets (solid thick lines) and is designed to be usable alternatingly by rotation about a normal to the plane of the plate, placed in the centre of the plate. This means that the gasket configuration in the lower half of the front side of the plate is similar to the one in the upper half of the front side of the adjoining plate. As is evident from FIG. 2, the outlet port 4 is provided with a flow limiter. Like in the embodiments described above, the flow limiter 5 is essentially U-shaped and positioned between the port in question and the opposite port portion. The two inlet ports 1, 3 are not provided with a flow limiter. In this case, this is not necessary since the two inner ports 2, 4 constitute a limitation of the flow since the flow from the inlet port 1, 3 in the two port portions must divide and flow on each side of the intermediate outlet ports 2, 4.

Figure 3:
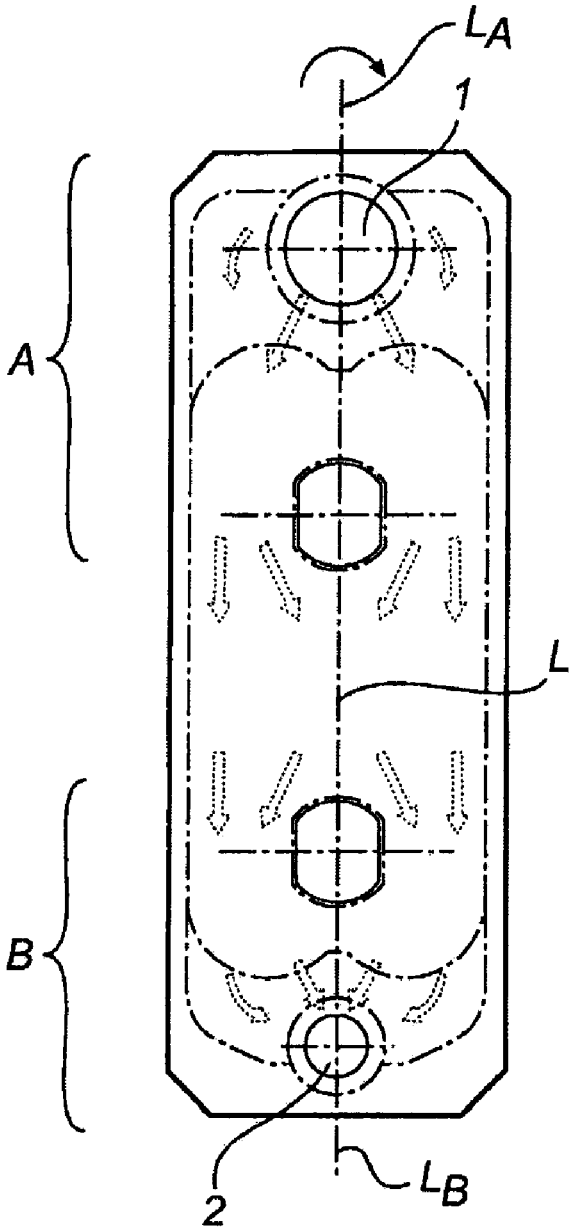
FIGS. 3-4 show a heat transfer plate which is intended for phase change of one of the fluids and which is usable alternatingly by rotation about its longitudinal axis. In this case, a phase change of vapour to liquid takes place (see FIG. 3).
Figure 4:
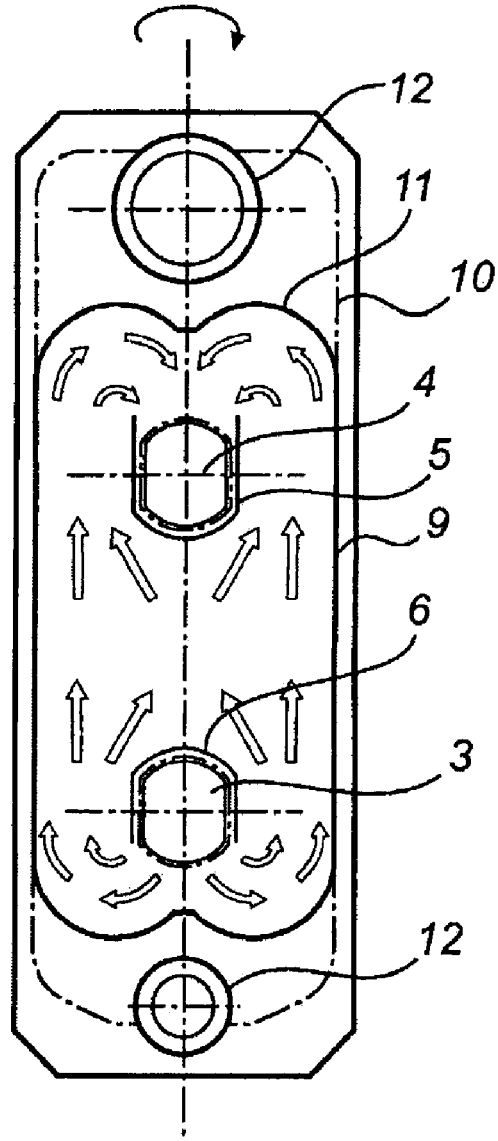

FIGS. 3-4 show yet another preferred embodiment. In this design, the two outer portions 1, 2 are in fluid communication with each other and the two inner ports 3, 4 are in fluid communication with each other. The two inner ports 3, 4 are provided with flow limiters 5, 6 of the type described above. The uppermost port 1 which constitutes the inlet port for the first fluid occupies a relatively large part of the width of the plate. In the variant shown in FIG. 10, the port 1 occupies the major part of the width of the plate. The lowermost port 2 which constitutes the outlet port for the first fluid is considerably smaller than the inlet port 1. In this case, it is also smaller than the two ports 3, 4 for the second fluid. The plate is a semi-welded plate, which means that the plates are welded together in pairs. In plates provided with gaskets, the corresponding function can be achieved by the gasket grooves being arranged in half-planes, which makes it possible to arrange gaskets on both sides of the plate.

In semi-welding, the ridges are arranged to be welded together with the corresponding ridge of an adjoining plate and they are adapted to form on the other side a trough which on some portions is adapted to hold a gasket. This is to be seen, for instance, in FIGS. 4 and 10 on the long sides where the solid thick line changes into a solid line that deviates inwards in the port portion and a dash dot line which continues upwards. The solid line along the long side designates a gasket 9 which is placed in a trough 10 which is pressed through the entire press depth and which on the other side defines a ridge intended for welding. When the solid line deviates inwards, it designates a gasket 11 placed in a trough which is only pressed to half the press depth. If this trough would be pressed to the entire press depth, it would define on the other side a sealing ridge, but in this case a flow from the uppermost port down to the actual heat transfer portion is allowed on the rear side. The dashed line continuing along the circumference of the plate designates the continuation of the trough pressed to the entire press depth, which on the other side defines a ridge intended for welding. Round the two outer ports 1, 2 there is a gasket groove which is pressed to essentially half the press depth and which supports a gasket 12 extending round the respective ports.

Instead of using alternatingly half the press depth and the entire press depth, it is possible to consistently use half the press depth and then arrange for gaskets to be placed in the grooves where sealing is desired. For example, gaskets would be arranged on both sides of the plate along its circumference while round the different ports there would be a gasket on one side only of the plate. The flow limiter may then be provided by placing a gasket in the gasket groove round the port or ports in question in the desired U-shaped extent that is evident from FIGS. 3, 4 and 10.

Figure 5:
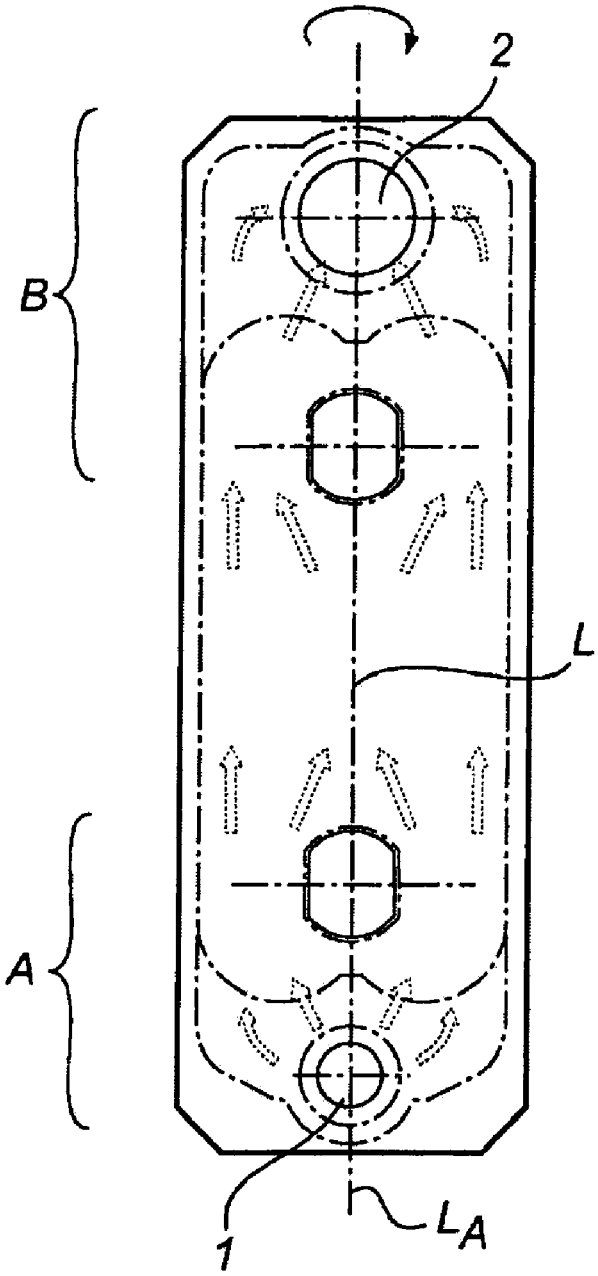
FIGS. 5-6 show a heat transfer plate which is intended for phase change of one of the fluids and which is usable alternatingly by rotation about its longitudinal axis. In this case, a phase change of liquid to vapour takes place (see FIG. 5).
Figure 6:
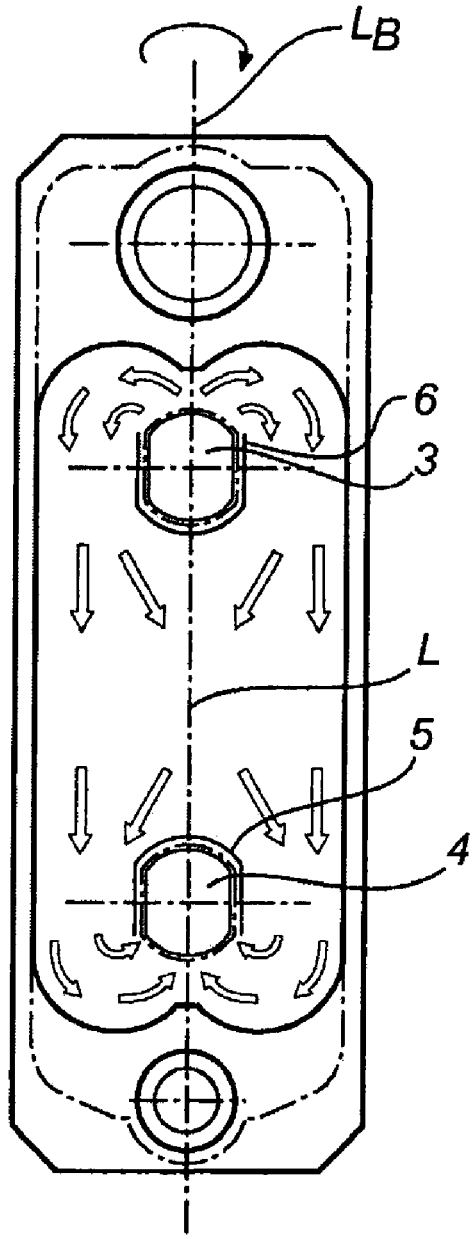
Figure 10:
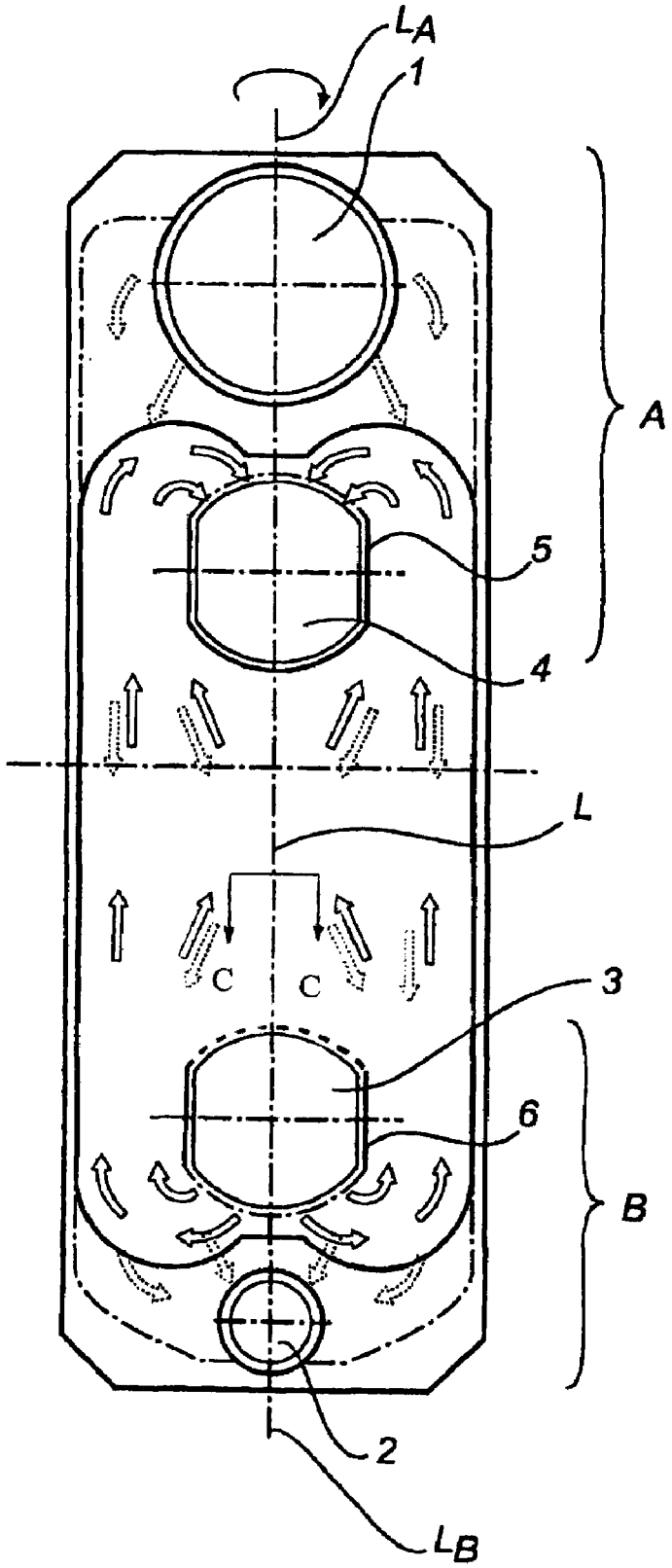
FIG. 10 shows an alternative design of the heat transfer plate illustrated in FIG. 3.

FIGS. 5-6 show a different way of using the plate in FIGS. 3-4 and 10. In this alternative use, the fluids flow in the opposite direction. This flow direction may be used when a fluid is to be evaporated. The evaporated fluid flows from the lower small port 1 up to the upper great port 2. The other fluid flows in the opposite direction between the two inner ports 3, 4. Otherwise, gaskets, welds, etc. are formed in one of the ways that are evident from the description in connection with the embodiment shown in FIGS. 3-4 and 10.

Figure 7:
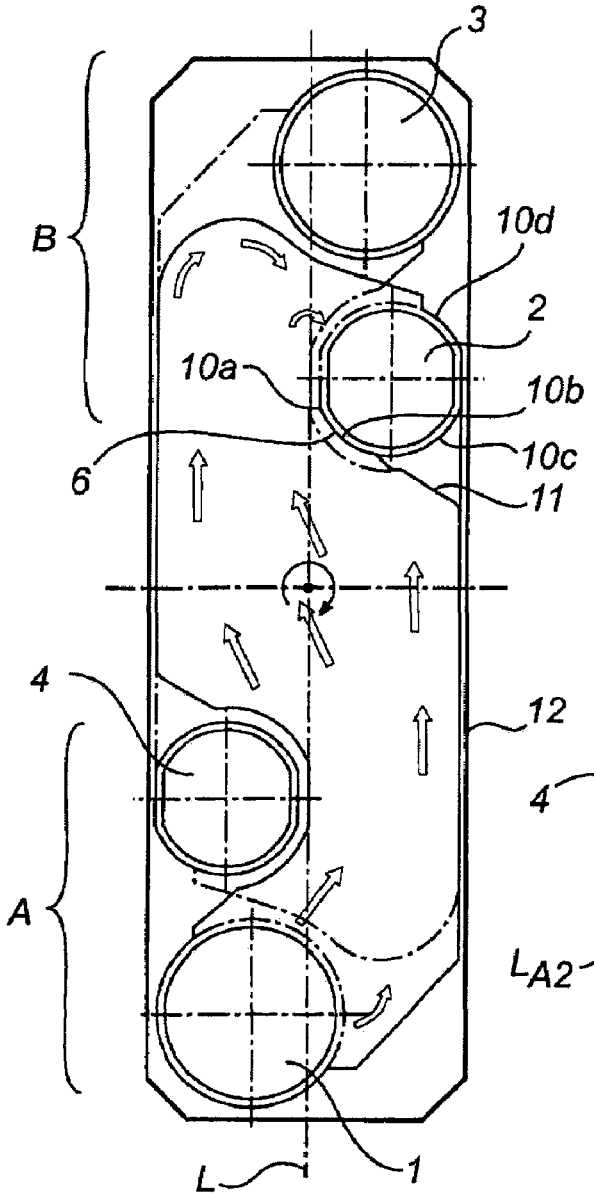
FIGS. 7-8 show a heat transfer plate which is designed to manage phase change for both fluids and which is usable alternatingly by rotation about a normal to the plane of the plate, placed in the centre of the plate.
Figure 8:
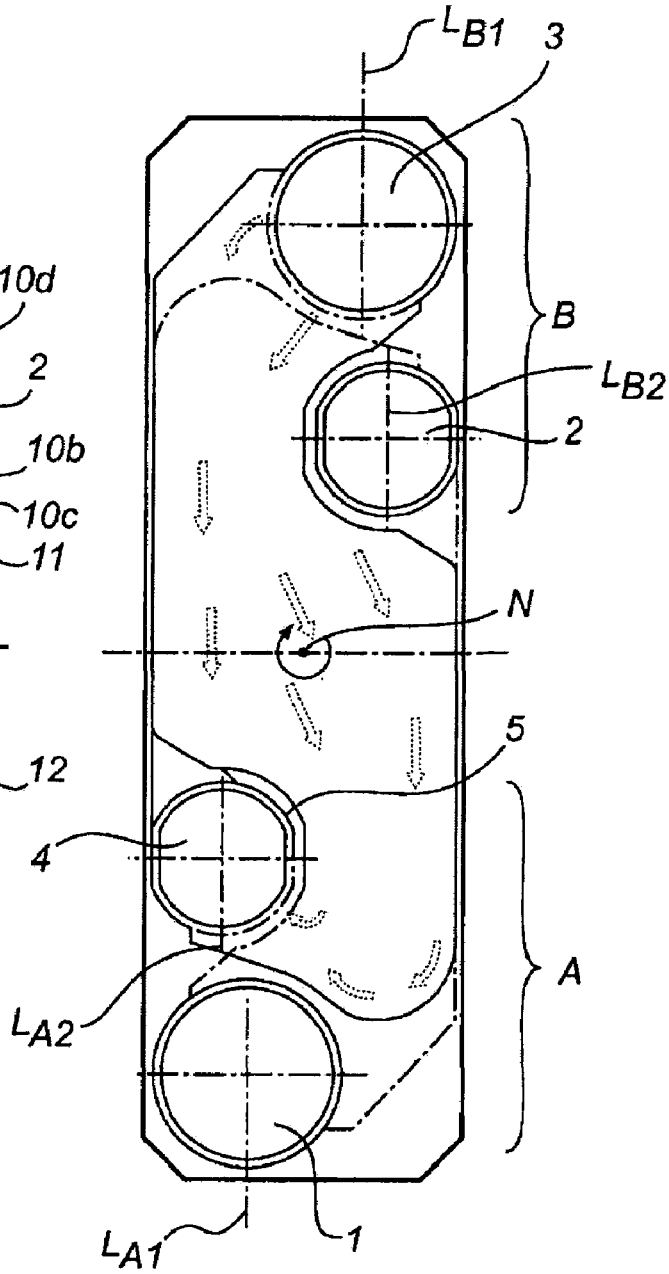

FIGS. 7-8 illustrate yet another preferred embodiment. In this plate, the ports 2, 3 in the upper port portion B are displaced towards one longitudinal edge and the ports 1, 4 in the lower port portion A are displaced towards the other longitudinal edge. The outer port 3 in the upper port portion B is in fluid communication with the inner port 4 in the lower port portion A. Correspondingly the inner port 2 in the upper port portion B is in fluid communication with the outer port 1 in the lower port portion A. The two outer ports 1, 3 are larger than the two inner ports 2, 4 and constitute inlet ports for the two fluids.

By configuring the ports in this way, it is possible to obtain flow paths of the same length and ports of different sizes for inlets 1, 3 and outlets 2, 4 for the two fluids. This is convenient, for instance, in order to achieve a good heat exchange capacity in applications involving phase change.

By displacing the ports in the manner that is to be seen in FIGS. 7-8, it is possible to use the surface of the plate in a very advantageous way. The fluid flow on each side can be conducted almost all the way up to the outer port 1, 3 and then be deflected back to the inner port 2, 4 (see, for example, the upper left corner in FIG. 7). This deflection is effected by means of flow limiters 5, 6 which extend along about half the circumference of the respective ports 2, 4. In the case illustrated in FIGS. 7-8, the flow limiters 5, 6 are of a shape that deviates slightly from the shapes shown in connection with the other preferred embodiments.

In FIG. 7 in the upper port portion B round the inner port 2, a sealing system (solid thick lines) is shown, which consists of a gasket 10 extending from just below the centre in the left side 10*a*, downwards 10*b*, up to the right side 10*c* and diagonally upwards to the left 10*d* between the inner port 2 and the outer port 3. Moreover there is a gasket 11 extending from the lowermost point obliquely downwards to the right out to the gasket 12 extending along the longitudinal edge. In this configuration, gaskets 10*a-c* which are located below the centre of the port 2 constitute a form of flow limiter 6 since they affect the fluid flow so that it cannot take the shortest path between the ports 2, 1 in question. This may also be expressed as if said flow limiter 6 extends along the circumference of said port to such an extent that each geometric straight line which can be constructed between said port 2 and a port 1 which is located in the opposite port portion and is intended for the same fluid extends through said flow limiter. All the preferred embodiments shown satisfy this feature. It is to be noted that in this case it is only the outlet ports 2, 4 that are provided with flow limiters 6, 5.

The plate shown in FIGS. 7-8 is intended to be sealed against adjoining plates by means of gaskets and is usable alternatingly by rotation about a normal N to the plane of the plate, placed in the centre.

Figure 9:
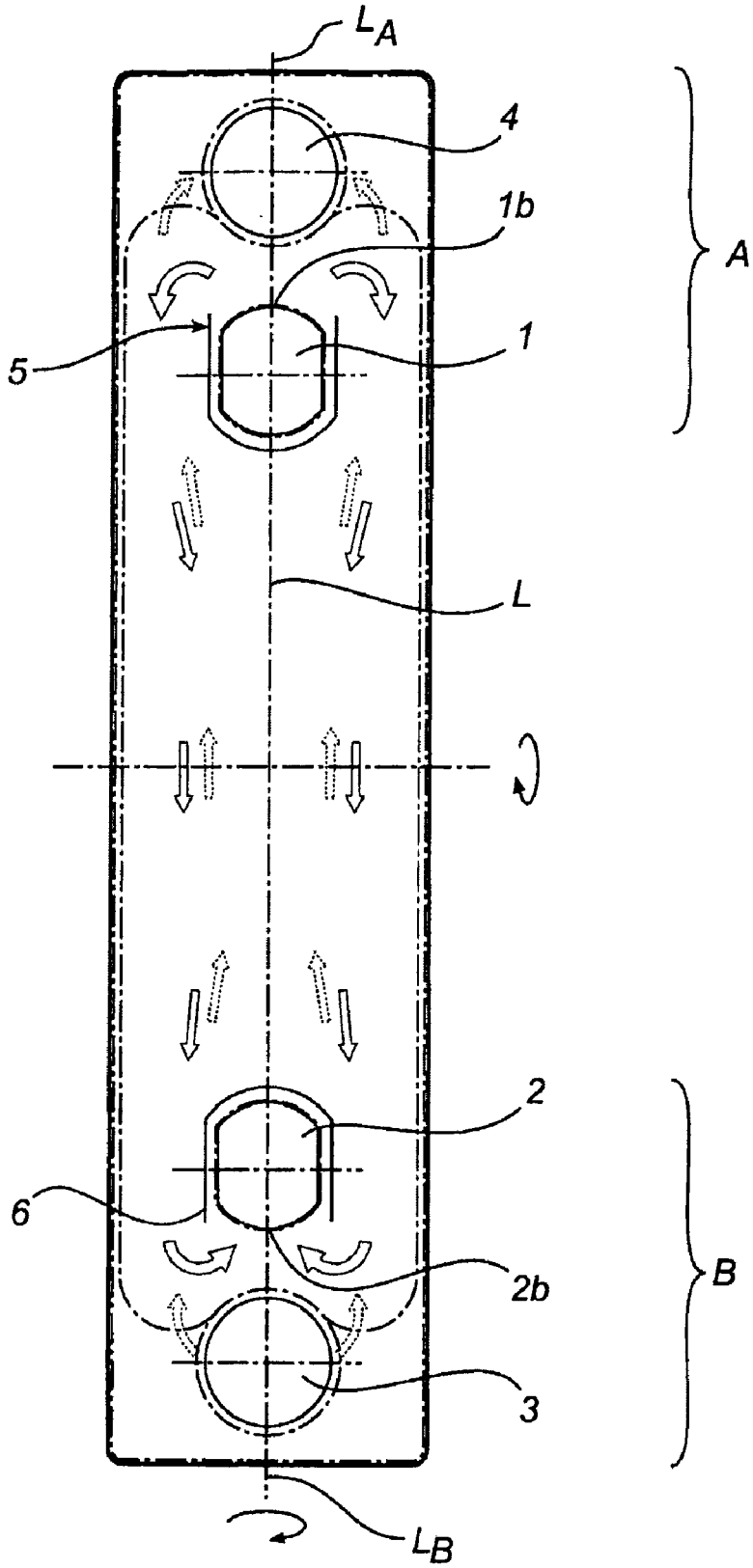
FIG. 9 shows a heat transfer plate which is usable alternatingly by rotation about its longitudinal axis or its transverse axis.

FIG. 9 shows yet another preferred embodiment. In this embodiment, the two ports 1, 2 are in fluid communication with each other and the two outer ports 3, 4 are in fluid communication with each other. The two inner ports 1, 2 are of a shape that is made up of a circle where its extent in the transverse direction is decreased by two straight edges. Moreover the flow limiters 5, 6 extend further outwards past the centre of the respective ports 1, 2 practically out to the outermost point 1*b*, 2*b* of the respective ports 1, 2. This design of the flow limiters 5, 6 results in extremely good flow distribution. Further the flattening of the inner ports 1, 2 causes the flow between the two outer ports 3, 4 to be obstructed to a relatively small extent. Otherwise, the plate corresponds to a plate of the type that is apparent from the embodiment illustrated in FIG. 1. For further details, reference is made to the description associated with FIG. 1.

It will be appreciated that many modifications of the described embodiments of the invention are conceivable within the scope of the invention, which is defined in the appended claims.

For example, it is possible to design the flow limiter so that it does not fully limit the flow but so that it is possible for a small partial flow to flow through the flow limiter. This is shown schematically in FIG. 10 where the lower flow limiter 6 has been broken through in some positions. A more or less broken-through flow limiter can be provided by the gasket or the ridge being made somewhat lower or even being removed completely along some short distances over the extent of the flow limiter.

The invention claimed is:

1. An essentially rectangular heat transfer plate for plate heat exchangers, comprising:

a first port portion which is located in a first edge portion at a first longitudinal end of the heat transfer plate and which comprises at least one port for each of two fluids, a second port portion which is located in a second edge portion at a second longitudinal end of the heat transfer plate and which comprises at least one port for each of the fluids, and a heat transfer portion which is located between said port portions, the ports in the first port portion being located along a first geometric line which is essentially parallel to a longitudinal direction of the plate, and the ports in the second port portion being located along a second geometric line which is essentially parallel to the longitudinal direction of the plate, wherein a flow limiter is arranged at least in the first port portion, substantially the entire length of the flow limiter being adjacent to the port which is located nearest the second port portion, the flow limiter is of such an extent that each straight geometric line, which is designed to extend between said adjacent port and a port which is located in the opposite port portion and is intended for the same fluid, extends through said flow limiter, the flow limiter is located between said adjacent port and the second port portion, the flow limiter comprises a pressed ridge which is formed integrally with the plate in a position spaced a distance along the plate from said adjacent port and which is arranged to abut against an adjoining heat transfer plate in the mounted position of the plate in a plate heat exchanger, wherein the flow limiter is arranged to define a fluid flow path between the adjacent port and the second port portion around the flow limiter, wherein the flow limiter is partly open in a region thereof closest to the second port portion to allow partial fluid flow through the flow limiter in said region; and wherein the partly open region of the flow limiter comprises one or more sections having a reduced height above the plate relative to other sections of the partly open region.

2. A heat transfer plate according to claim 1, wherein said port provided with a flow limiter constitutes an inlet port for one of the fluids.

3. A heat transfer plate according to claim 1, wherein said port provided with a flow limiter constitutes an outlet port for one of the fluids.

4. A heat transfer plate according to claim 1, wherein a further flow limiter is arranged in the second port portion, substantially the entire length of the flow limiter being adjacent to one of the ports which on the one hand is located nearest the first port portion and, on the other hand, constitutes an outlet port for one of the fluids.

5. A heat transfer plate according to claim 4, wherein said further flow limiter is of such an extent that each straight geometric line, which is designed to extend between said adjacent port and a port which is located in the opposite port portion and is intended for the same fluid, extends through said flow limiter.

6. A heat transfer plate according to claim 4, wherein said further flow limiter is located between said adjacent port and the first port portion.

7. A heat transfer plate according to claim 1, wherein the ports in each of the port portions are located along one and the same geometric line.

8. A heat transfer plate according to claim 1, wherein the ports which in the respective port portions are located nearest the opposite port portion are intended for a first fluid and the ports which in the respective port portions are located furthest away from the opposite port portion are intended for a second fluid.

9. A heat transfer plate according to claim 1, wherein the ports are arranged symmetrically in relation to a symmetry line.

10. A heat transfer plate according to claim 9, wherein said symmetry line extends in the plane of the plate.

11. A heat transfer plate according to claim 10, wherein said symmetry line extends along a main flow direction of said fluids.

12. A plate pack for plate heat exchangers comprising a number of heat transfer plates of the kinds as defined in claim 1.

13. A plate heat exchanger comprising a number of heat transfer plates of the kind as defined in claim 1.

14. The heat transfer plate according to claim 1 wherein each of the one or more reduced height sections of the partly open region forms a path that accommodates at least part of the partial fluid flow through the flow limiter.

15. The heat transfer plate according to claim 1 comprising a plurality of reduced height sections.

* * * * *